US010459394B2

(12) United States Patent
Morita

(10) Patent No.: US 10,459,394 B2
(45) Date of Patent: Oct. 29, 2019

(54) SHEET STACKING UNIT, AND SHEET CONVEYING DEVICE AND IMAGE FORMING APPARATUS EACH INCLUDING THE SHEET STACKING UNIT

(71) Applicant: KYOCERA Document Solutions Inc., Osaka (JP)

(72) Inventor: Takashi Morita, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/706,325

(22) Filed: Sep. 15, 2017

(65) Prior Publication Data

US 2018/0095401 A1 Apr. 5, 2018

(30) Foreign Application Priority Data

Sep. 30, 2016 (JP) ..... 2016-194055

(51) Int. Cl.
*B65H 1/04* (2006.01)
*G03G 15/00* (2006.01)

(52) U.S. Cl.
CPC ..... *G03G 15/6502* (2013.01); *B65H 1/04* (2013.01); *B65H 2301/4222* (2013.01);
(Continued)

(58) Field of Classification Search
CPC .. B65H 1/04; B65H 1/266; B65H 2301/4222; B65H 2405/1142; B65H 2405/11425;
(Continued)

(56) References Cited

U.S. PATENT DOCUMENTS 5,573,236 A * 11/1996 Petocchi ..... B65H 1/00 250/214 PR
6,164,639 A * 12/2000 Toh ..... B65H 1/00 250/559.19

(Continued)

FOREIGN PATENT DOCUMENTS

JP 11-331580 A 11/1999
JP 2000-16596 A 1/2000

(Continued)

OTHER PUBLICATIONS

Chinese Office Action dated Nov. 29, 2018, issued by the China National Intellectual Property Administration in corresponding application CN 201710851176.1.

(Continued)

*Primary Examiner* — Ernesto A Suarez
(74) *Attorney, Agent, or Firm* — Stein IP, LLC

(57) ABSTRACT

A sheet stacking unit of the disclosure includes a sheet stacking plate, a cursor, and a detection sensor. The cursor includes an alignment part for performing widthwise alignment of a document, and a rack extending along the widthwise direction. The detection sensor is placed opposite the rack, and has a light-emitting portion and a light-receiving portion. A plurality of detection-object parts placed in the rack along the widthwise direction have optical characteristics of different reflectivities or transmissivities from one another with respect to light emitted from the light-emitting portion. The controller detects a widthwise size of the document on a basis of output values from the detection sensor which detects light reflected or transmitted by the detection-object parts.

7 Claims, 5 Drawing Sheets

(52) U.S. Cl.
CPC ..... *B65H 2403/411* (2013.01); *B65H 2405/1142* (2013.01); *B65H 2511/12* (2013.01); *G03G 15/607* (2013.01); *G03G 15/6552* (2013.01); *G03G 15/6567* (2013.01); *G03G 2215/00616* (2013.01); *G03G 2215/00734* (2013.01)

(58) Field of Classification Search
CPC ..... B65H 2405/1144; B65H 2511/12; B65H 2403/411
USPC ..... 271/171; 399/370, 376
See application file for complete search history.

(56) References Cited

U.S. PATENT DOCUMENTS

| | | | | |
|---|---|---|---|---|
| 6,805,345 | B2 * | 10/2004 | Furukawa | B65H 1/04 271/171 |
| 7,231,172 | B2 * | 6/2007 | Park | G03G 15/65 271/171 |
| 7,992,862 | B2 * | 8/2011 | Kuo | B65H 1/00 271/171 |
| 9,219,836 | B2 * | 12/2015 | Bouverie | H04N 1/00689 |
| 2008/0044216 | A1 * | 2/2008 | Kim | B41J 11/003 400/708 |
| 2009/0008860 | A1 * | 1/2009 | Chen | B65H 1/04 271/9.06 |
| 2011/0169215 | A1 * | 7/2011 | Oh | B65H 1/266 271/227 |
| 2016/0122142 | A1 | 5/2016 | Okada et al. | |

FOREIGN PATENT DOCUMENTS

| | | | |
|---|---|---|---|
| JP | 2001-322723 | A | 11/2001 |
| JP | 2005-154127 | A | 6/2005 |
| JP | 2007-197146 | A | 8/2007 |
| JP | 2012-10137 | A | 1/2012 |
| JP | 2016-88629 | A | 5/2016 |

OTHER PUBLICATIONS

Japanese Office Action dated Nov. 29, 2018, issued by the Japanese Patent Office in corresponding application JP 201710851176.1.
Japanese Office Action dated May 7, 2019, issued by the Japanese Patent Office in corresponding application JP 2016-194055.

* cited by examiner

SHEET STACKING UNIT, AND SHEET CONVEYING DEVICE AND IMAGE FORMING APPARATUS EACH INCLUDING THE SHEET STACKING UNIT

INCORPORATION BY REFERENCE

This application is based upon and claims the benefit of priority from the corresponding Japanese Patent Application No. 2016-194055 filed on Sep. 30, 2016, the entire contents of which are incorporated herein by reference.

BACKGROUND

The present disclosure relates to a sheet stacking unit including a sheet stacking plate and a cursor for performing widthwise alignment of sheets set on the sheet stacking plate, as well as to a sheet conveying device and an image forming apparatus both including the sheet stacking unit.

Conventionally, there has been widely used a sheet stacking unit which includes: a sheet stacking plate; a pair of cursors being movable in a sheet widthwise direction and each having an alignment part for performing widthwise alignment of sheets set on the sheet stacking plate as well as a rack extending along the sheet widthwise direction; and a pinion which is to be engaged with a pair of racks and which is rotated along with movement of the racks.

In the conventional sheet stacking unit, for example, a resistive position sensor is provided on the pinion in order to detect a sheet width (sheet size). Moving the cursors in line with the sheet width causes the pinion to rotate, and a signal of a level corresponding to a rotational amount of the pinion is outputted from the position sensor. Then, based on this signal level, the sheet width is detected.

SUMMARY

A sheet stacking unit in a first aspect of the present disclosure includes a placement body, a sheet stacking plate, a cursor, a rack, a pinion, a detection sensor, a plurality of detection-object parts, and a controller. The sheet stacking plate has sheets stacked thereon together with the placement body. The cursor is movable on an upper surface of the placement body in a widthwise direction perpendicular to a sheet conveyance direction, and the cursor is brought into contact with widthwise side faces of sheets placed on the sheet stacking plate to align the sheets. The rack is coupled to the cursor and extends along the widthwise direction. The pinion is provided inside the placement body to make up a rack and pinion mechanism in cooperation with the rack. The detection sensor is placed opposite the rack and has a light-emitting portion and a light-receiving portion. The plurality of detection-object parts are placed in the rack along the widthwise direction and are to be detected by the detection sensor while the cursor is set in specified positions. The controller detects a position of the cursor in correspondence to an output of the detection sensor to thereby identify a widthwise size of the sheet. The plurality of detection-object parts have optical characteristics of reflectivities or transmissivities, which are different from one another, with respect to light emitted from the light-emitting portion. In the detection sensor, light emitted from the light-emitting portion is received via the detection-object parts by the light-receiving portion. The controller identifies the widthwise size of the sheet on a basis of output values from the detection sensor which detects light reflected or transmitted by the detection-object parts.

Still other objects of the present disclosure and concrete advantages obtained by the disclosure will become more apparent from the description of its embodiments given below.

DETAILED DESCRIPTION

Hereinbelow, embodiments of the present disclosure will be described with reference to the accompanying drawings.

First Embodiment

Figure 1:
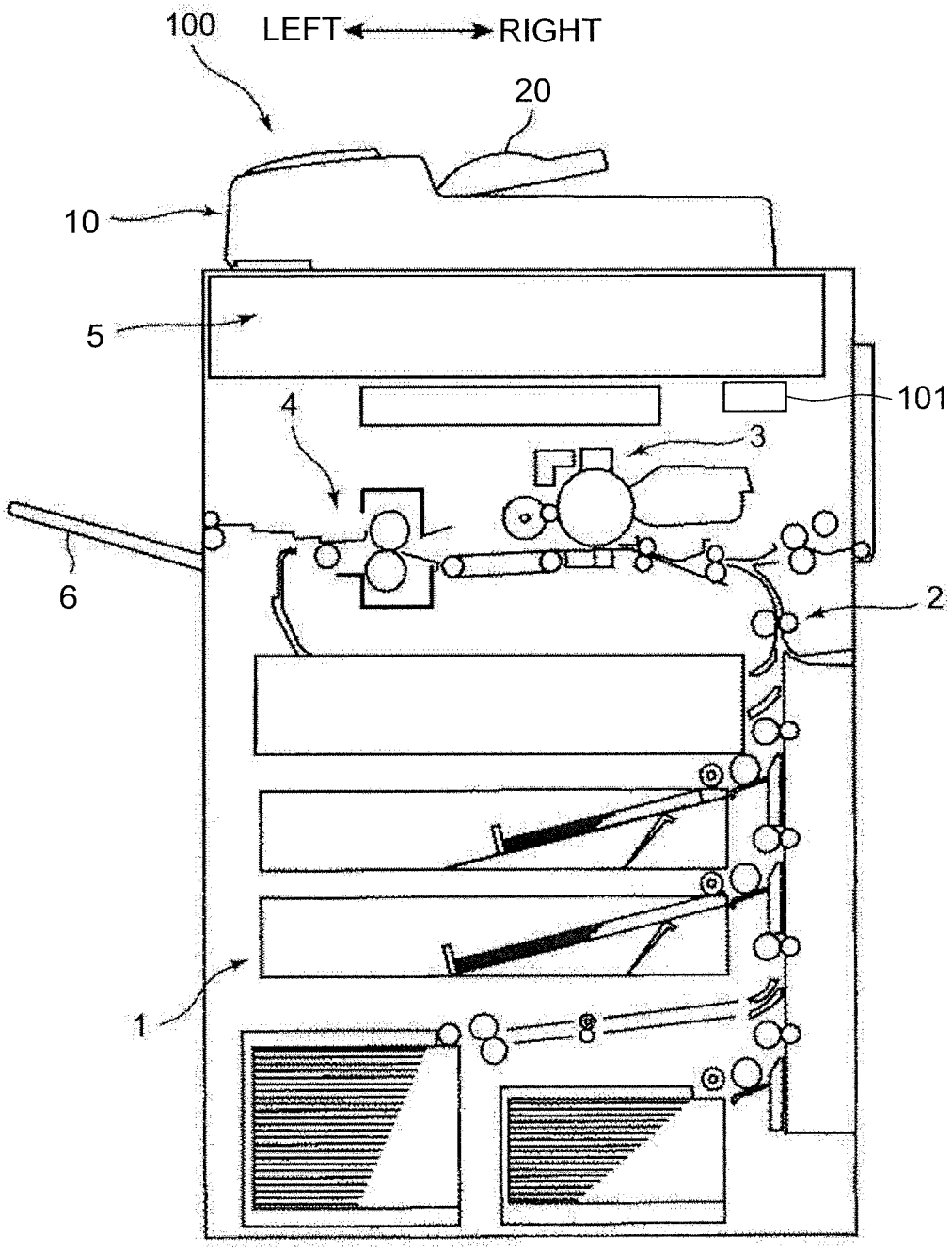
FIG. 1 is a sectional view schematically showing a structure of an image forming apparatus including a document stacking tray according to a first embodiment of the disclosure.

FIG. 1 is a sectional view schematically showing a structure of an image forming apparatus 100 including a document stacking tray (sheet stacking unit) 20 according to a first embodiment of the disclosure. The image forming apparatus 100 includes a sheet feed part 1 provided in lower part of an apparatus body, a sheet conveying part 2 provided rightward and upward of the sheet feed part 1, an image forming unit 3 provided upward of the sheet conveying part 2, a fixing part 4 provided on a sheet-conveyance-direction downstream side of the image forming unit 3, an image reading part (image reading device) 5 provided above these image forming unit 3 and fixing part 4, and a document conveying device (sheet conveying device) 10 provided above the image reading part 5.

The sheet conveying part 2 conveys a sheet of paper fed from the sheet feed part 1 toward the image forming unit 3, and further discharges the sheet, which has been subjected to image formation in the image forming unit 3 to the fixing part 4, onto a discharge tray 6.

The image forming unit 3 forms a specified toner image on the sheet on a basis of document image data read by the image reading part 5 by electrophotographic process. The fixing part 4 fixes the toner image on the sheet, onto which the toner image has been transferred in the image forming unit 3.

The image reading part 5 applies light to a document transported by the document conveying device 10 or a document set on a contact glass, and converts resulting reflected light into electric signals to read document image information as well as to generate image data corresponding to the document image.

Figure 2:
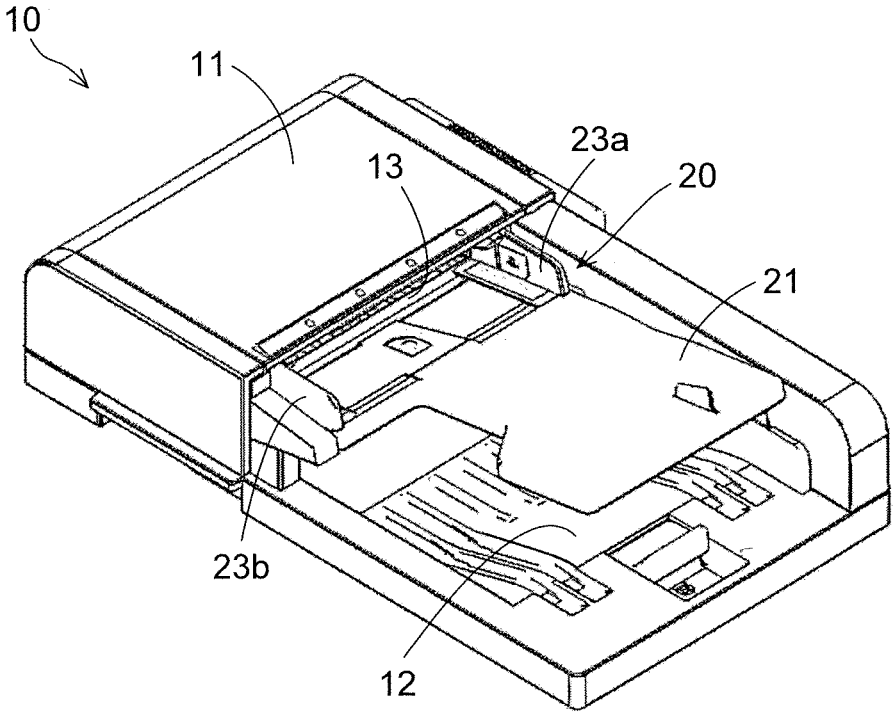
FIG. 2 is a perspective view showing a structure of a document conveying device including the document stacking tray according to the first embodiment of the disclosure.

The document conveying device 10 is a device for performing so-called sheet-through type document reading in which document sheets set on the document stacking tray 20 are conveyed one by one automatically in response to an input of copying start instruction or the like, and in which a conveyed-up document sheet, after reading of the document image by the image reading part 5, is discharged onto a discharge tray 12 (see FIG. 2).

As shown in FIG. 2, the document conveying device 10 is provided with the document stacking tray 20 on which documents (sheets) are to be set, a document conveying part sheet conveying part) 11 for conveying the document set on the document stacking tray 20, and the discharge tray 12 which is placed below the document stacking tray 20 and on which a discharged document is to be placed. A document conveyance path (not shown) extending from the document stacking tray 20 to the discharge tray 12 is formed in the document conveying part 11. A document insertion inlet 13 into which the document on the document stacking tray 20 is to be inserted is provided at a document-conveyance-direction upstream end of the document conveyance path (not shown). At its document-conveyance-direction downstream end, a document discharge outlet (not shown) is provided so that the document having its image read by the image reading part 5 is discharged therethrough. Also, within the document conveying part 11, unshown document conveyance members such as a pickup roller, a sheet feed roller, a separation plate, a conveyance roller pair, and a discharge roller pair are provided along the document conveyance path (not shown).

Figure 3:
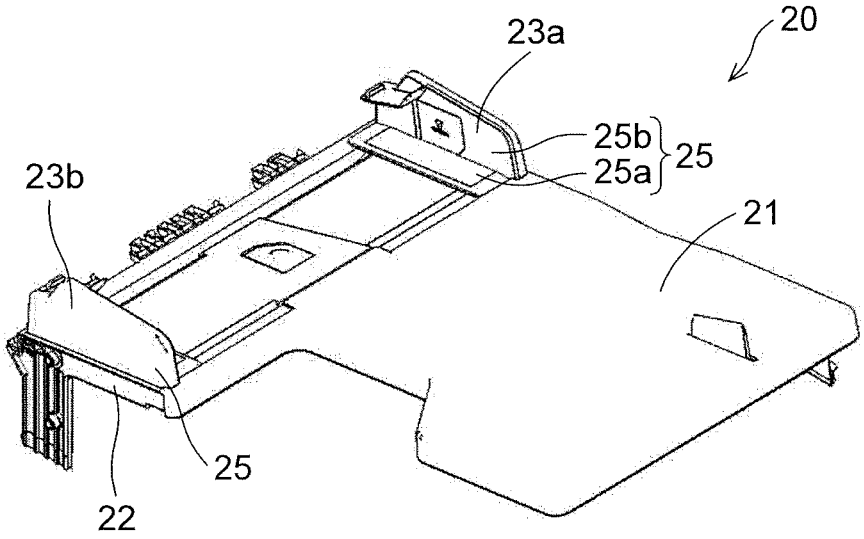
FIG. 3 is a perspective view showing a structure of the document stacking tray according to the first embodiment of the disclosure.

As shown in FIG. 3, the document stacking tray 20 includes a document stacking plate (sheet stacking plate) 21 on which the document (sheets) is to be stacked, a tray body (placement body) 22 which is placed on the document-conveyance-direction downstream side of the document stacking plate 21 and to which the document stacking plate 21 is to be fitted, and a pair of cursors 23*a* and 23*b* which are to be brought into contact with side faces of the document in its widthwise direction (direction perpendicular to the document conveyance direction) to thereby achieve alignment of the document.

In an upper surface of the tray body 22, slits are formed so as to extend in the document widthwise direction (direction perpendicular to the document conveyance direction), so that the cursors 23*a* and 23*b* are movable along the slits.

Figure 4:
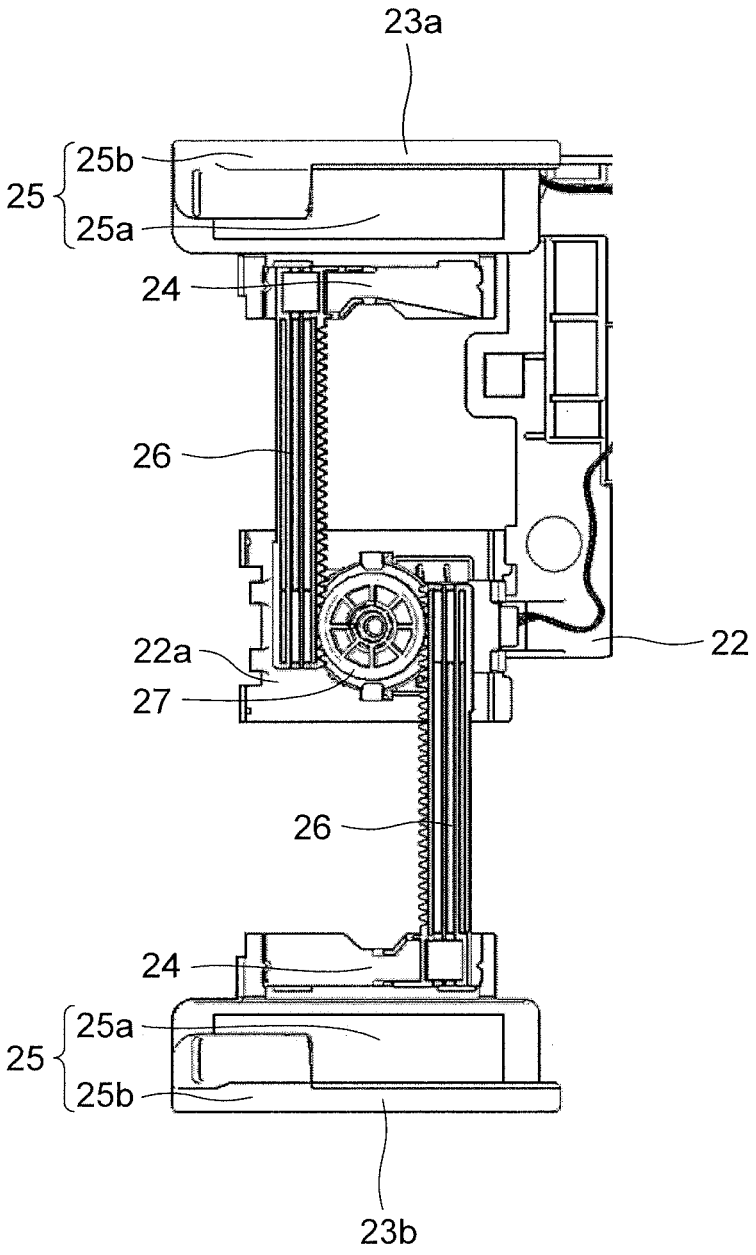
FIG. 4 is a plan view showing a structure of cursors' vicinity except a document stacking plate of the document stacking tray according to the first embodiment of the disclosure.

As shown in FIG. 4, each of the cursors 23*a* and 23*b* includes an alignment part 25 for performing widthwise alignment of the document set on the document stacking plate 21 (see FIG. 3), a rack 26 placed inside the tray body 22 and extending along the document widthwise direction (up/down direction of FIG. 4), and a coupling part 24 for coupling the alignment part 25 and the rack 26 to each other. The alignment part 25 is composed of a base portion 25*a* parallel to the tray body 22, and a restricting portion 25*b* provided erect from the base portion 25*a*. The coupling part 24 couples a lower portion of the base portion 25*a* and an end portion of the rack 26 to each other. In addition, the alignment part 25, the coupling part 24 and the rack 26 may be formed integrally by fitting or the like, or may be integrally molded by resin molding.

On document-conveyance-direction opposite surfaces of the individual racks 26, rack teeth extending along the document widthwise direction are formed. The rack teeth of each rack 26 are engaged with pinion teeth of the pinion 27 rotatably mounted on the tray body 22. The rack 26 and the pinion 27 constitute a rack and pinion mechanism.

In a central portion of the pinion 27, a shank portion 27*a* (see FIG. 6) protruding downward is formed. The shank portion 27*a* is rotatably inserted into an insertion hole of a support member 22*a* provided in the tray body 22. The pinion 27 is rotatable along with motion of the rack 26. As one cursor 23*a* (or 23*b*) is moved in the document widthwise direction, the pinion 27 is rotated and, in linkage with this, the other cursor 23*b* (or 23*a*) is also moved in the opposite direction to an equal extent. That is, the cursors 23*a* and 23*b* are moved right-and-left symmetrically with respect to a document-widthwise-direction center line.

Figure 5:
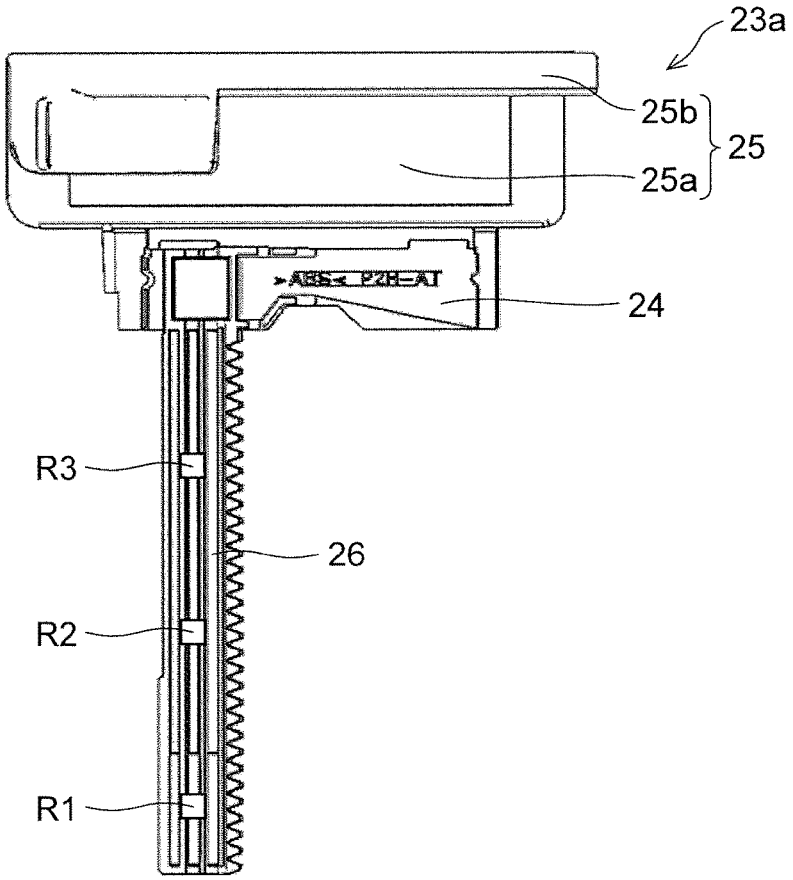
FIG. 5 is a plan view showing a structure of a cursor which is equipped with a detection-object portion of the document stacking tray according to the first embodiment of the disclosure.

With regard to the rack 26 of one cursor (cursor 23*a* in this case), as shown in FIG. 5, a plurality (three in this case) of detection-object parts R1, R2 and R3 having different optical characteristics are provided with specified spacings from one another along the document widthwise direction. The detection-object parts R1 to R3 have optical characteristics different from those of the rest of the rack 26 other than the detection-object parts R1 to R3. In this embodiment, the detection-object parts R1 to R3 are formed so that their light transmissivities differ from one another. In addition, the detection-object parts R1 to R3 are provided at positions corresponding to widthwise sizes of plural kinds (three kinds in this case) of regular-sized documents, respectively.

Figure 6:
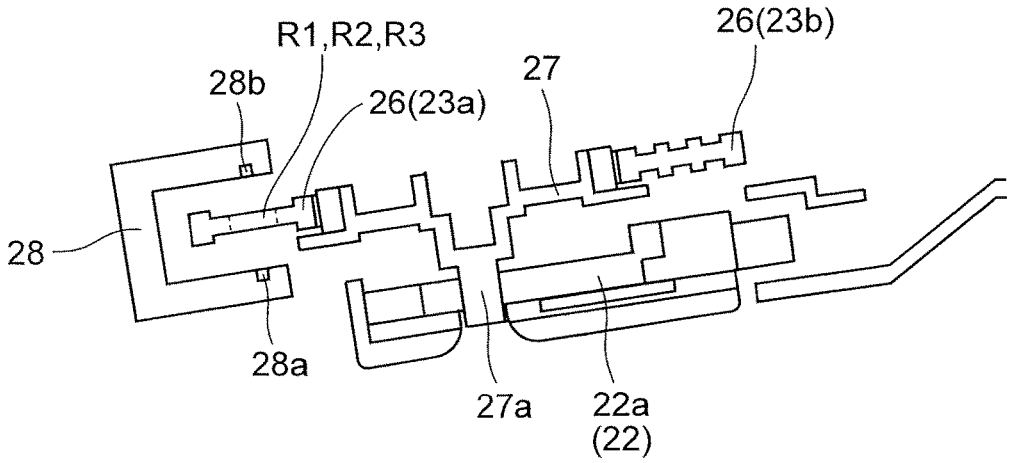
FIG. 6 is a sectional view showing a structure of a detection sensor's vicinity of the document stacking tray according to the first embodiment of the disclosure.

Also in the tray body 22, as shown in FIG. 6, a detection sensor 28 for detecting a document width (widthwise size of a document) is provided opposite the rack 26 of the cursor 23*a*. The detection sensor 28 is a P1 sensor having a light-emitting portion 28*a* and a light-receiving portion 28*b*. In this embodiment, the detection sensor 28 is a transmission-type sensor, the light-emitting portion 28*a* is placed opposite a lower surface (or upper surface) of the rack 26, and the light-receiving portion 28*b* is placed opposite an upper surface (or lower surface) of the rack 26. That is, the light-emitting portion 28*a* and the light-receiving portion 28*b* are placed in opposition to each other so that the detection-object parts R1 to R3 provided in the rack 26 are interposed therebetween in the thicknesswise direction.

The light-emitting portion 28*a* emits light toward the light-receiving portion 28*b*, and the light-receiving portion 28*b* receives light transmitted by the detection-object parts R1 to R3. In this case, the light-receiving portion 28*b* receives light of quantities corresponding to optical characteristics (light transmissivities) of the detection-object parts R1 to R3, respectively. Then, the detection sensor 28 outputs detection signals corresponding to received-light quantities to a controller (see FIG. 1) 101 for controlling the whole image forming apparatus 100 (or document conveying device 10). The controller 101 detects positions of the cursors 23*a* and 23*b* on a basis of output values of the received detection signals to identifies a widthwise size of the document.

Various methods may be mentioned for the method of making up the detection-object parts R1 to R3 so that their light transmissivities differ from one another.

For example, the detection-object parts R1 to R3 may be formed so that their light transmissivities differ from one another due to thickness differences. In this case, preferably, the detection-object parts R1 to R3 are formed from semi-transparent resin.

Also, at least one of lower surface and upper surface of the detection-object parts R1 to R3 may be subjected to emboss processing of individually different sizes of pits and bumps. In this case, preferably, the detection-object parts R1 to R3 are formed from semitransparent resin or transparent resin.

Moreover, sheet members of individually different light transmissivities may be attached to the detection-object parts R1 to R3, respectively. In this case, preferably, the detection-object parts R1 to R3 are formed of transparent resin or semitransparent resin.

Although the detection-object parts R1 to R3 are, preferably, integrally molded by using the same resin as the rack 26, yet the detection-object parts R1 to R3 may also be two-color molded by using a different resin from the rack 26. It is also allowable that while opening portions are provided at portions of the rack 26 corresponding to the detection-object parts R1 to R3, respectively, resin members or sheet members of individually different light transmissivities may be attached to those opening portions.

In this embodiment, as described above, the plural detection-object parts R1 to R3 placed in the rack 26 along the widthwise direction have individually different optical characteristics. The controller 101 detects a document width on the basis of output values outputted by the light-receiving portion 28*b* that has received light of quantities corresponding to the optical characteristics of the detection-object parts R1 to R3. Accordingly, moving the cursors 23*a* and 23*b* in line with the document width causes the rack 26 to be moved as well, in which state light of quantities corresponding to the optical characteristics of the detection-object parts R1 to R3 opposed to the detection sensor 28 are received by the light-receiving portion 28*b*. Therefore, on the basis of output values corresponding to received-light quantities received by the light-receiving portion 28*b*, positions of the cursors 23*a* and 23*b*, i.e., the document width can be detected. In this case, since the position of the cursor 23*a* is directly detected by the detection sensor 28, it becomes possible to accurately detect the document width, unlike the case in which the cursor position is indirectly detected by using rotational quantity of the pinion as in the conventional sheet stacking unit. Moreover, structural simplification as well as cost reduction of the document stacking tray 20 can be fulfilled.

With use of a noncontact-type sensor as the detection sensor 28, it becomes possible to suppress any increases in the load involved in movement of the cursors 23*a* and 23*b*.

As described above, the detection-object parts R1 to R3 have different light transmissivities from one another, and the detection sensor 28 is so designed that light is emitted from the light-emitting portion 28*a* and light transmitted by any one of the detection-object parts R1 to R3 is received by the light-receiving portion 28*b*. As a result of this, the document width can be detected simply by using the transmission-type detection sensor 28.

As described above, the detection-object parts R1 to R3 may also be formed so that their thicknesses differ from one another. The surfaces of the detection-object parts R1 to R3 may also be subjected to emboss processing of different sizes of pits and bumps. Moreover, the detection-object parts R1 to R3 may be provided with sheet members having different light transmissivities, respectively. With such formation, the detection-object parts R1 to R3 can simply be made up so that their light transmissivities differ from one another.

As described above, the detection-object parts R1 to R3 are provided at positions corresponding to widthwise sizes of plural types of regular-sized documents, respectively. As a result of this, the document width can be detected simply by using the detection-object parts R1 to R3.

As described above, the present disclosure may simply be applied to a document stacking tray 20 which includes a pair of cursors 23*a* and 23*b* each having the rack 26 as well as the pinion 27. Moreover, since moving the cursor 23*a* causes the cursor 23*b* to be moved in an opposite direction to the same extent relative to the cursor 23*a*, there is no need for providing the detection-object parts R1 to R3 in the cursors 23*a* and 23*b*, and also the detection sensor 28 does not need to be provided two in quantity.

Second Embodiment

In the document stacking tray 20 according to a second embodiment of this disclosure, the detection-object parts R1 to R3 are so formed that their light reflectivities differ from one another.

Figure 7:
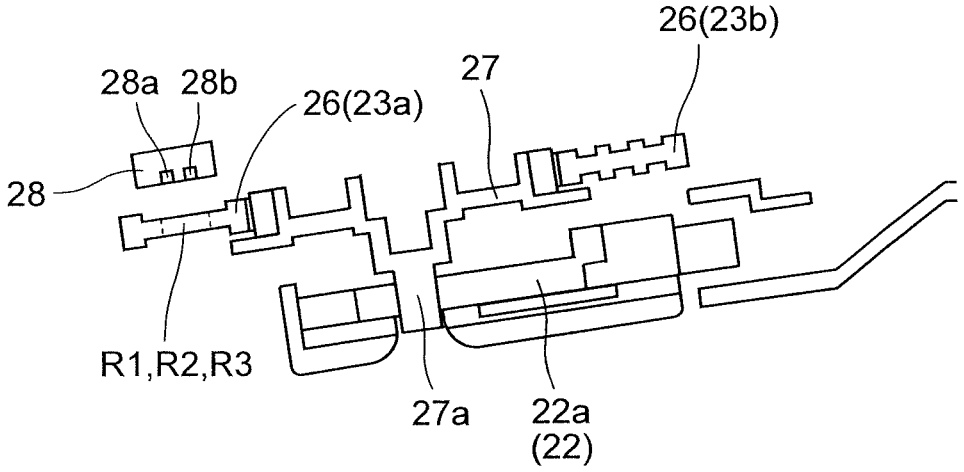
FIG. 7 is a sectional view showing a structure of a detection sensor's vicinity of a document stacking tray according to a second embodiment of the disclosure.

In this embodiment, as shown in FIG. 7, the detection sensor 28 is a reflection-type sensor, and the light-emitting portion 28*a* and the light-receiving portion 28*b* are placed so as to be opposed to the upper surface or lower surface (upper surface in this case) of the rack 26. That is, the light-emitting portion 28*a* and the light-receiving portion 28*b* are placed on one thicknesswise identical side of the rack 26.

The light-emitting portion 28*a* emits light toward the detection-object parts R1 to R3, and the light-receiving portion 28*b* receives light reflected by the detection-object parts R1 to R3. In this case, the light-receiving portion 28*b* receives light of quantities corresponding to the optical characteristics (light reflectivities) of the detection-object parts R1 to R3, respectively.

Various methods may be mentioned for the method of making up the detection-object parts R1 to R3 so that their light reflectivities differ from one another.

For example, the upper surface or lower surface (surface to which the light-emitting portion 28*a* and the light-receiving portion 28*b* are opposed in placement; upper surface in this case) of the detection-object parts R1 to R3 may be subjected to emboss processing of different sizes of pits and bumps.

Further, sheet members of different light reflectivities from one another may also be attached to the detection-object parts R1 to R3, respectively.

In addition, in this embodiment, since the light-receiving portion 28*b* receives light reflected by the detection-object parts R1 to R3, there is no need for forming the detection-object parts R1 to R3 from semitransparent resin or transparent resin, unlike the first embodiment.

The rest of the structure of this embodiment is similar to that of the first embodiment.

In this embodiment, as described above, the detection-object parts R1 to R3 have different light transmissivities from one another. In the detection sensor 28, light emitted from the light-emitting portion 28*a* and reflected by any one of the detection-object parts R1 to R3 is received by the light-receiving portion 28*b*. Thus, the document width can be detected simply by using the reflection-type detection sensor 28.

Also, as described above, surfaces of the detection-object parts R1 to R3 may be subjected to emboss processing of different sizes of pits and bumps. Moreover, the detection-object parts R1 to R3 may also be provided with sheet members of individually different light reflectivities. With such formation, the detection-object parts R1 to R3 can simply be made up so as to differ in light reflectivity from one another.

The rest of effects of this embodiment are similar to those of the first embodiment.

The embodiments disclosed herein should be construed as not being limitative but being an exemplification at all points. The scope of the disclosure is defined not by the above description of the embodiments but by the appended claims, including all changes and modifications equivalent in sense and range to the claims.

For example, the foregoing embodiments have been described on cases in which the document stacking tray 20 provided in the document conveying device 10 is taken as an example of the sheet stacking unit of this disclosure. However, this disclosure is not limited to this. The disclosure may be applied to manual feed trays (sheet stacking units). Further, the disclosure may also be applied to sheet feed cassettes (sheet stacking units) which are fittable to and removable from the image forming apparatus body and in which a paper stacking plate (sheet stacking plate) swings vertically.

Furthermore, the foregoing embodiments have been described on a case in which only one cursor (cursor 23*a* in this case) is provided with the detection-object parts R1 to R3, and in which the detection sensor 28 is provided only one in quantity. However, the disclosure is not limited to this. The detection-object parts R1 to R3 may be provided on both cursors 23*a* and 23*b*, and moreover the detection sensor 28 may be provided two in quantity.

What is claimed is:

1. A sheet stacking unit comprising:

a placement body;

a sheet stacking plate on which sheets are to be stacked together with the placement body;

a cursor which is movable on an upper surface of the placement body in a widthwise direction perpendicular to a sheet conveyance direction and which is brought into contact with widthwise side faces of the sheets placed on the sheet stacking plate to align the sheets;

a rack coupled to the cursor and extending along the widthwise direction;

a pinion provided in the placement body to make up a rack and pinion mechanism in cooperation with the rack;

a detection sensor which is placed opposite the rack and which has a light-emitting portion and a light-receiving portion;

a plurality of detection-object parts which are placed in the rack along the widthwise direction and which are to be detected by the detection sensor while the cursor is set in specified positions; and a controller which detects a position of the cursor in correspondence to an output of the detection sensor to thereby identify a widthwise size of the sheet, wherein the plurality of detection-object parts have optical characteristics of transmissivities, which are different from one another, with respect to light emitted from the light-emitting portion, the controller identifies the widthwise size of the sheet on a basis of output values from the detection sensor which detects light transmitted by the detection-object parts, in the detection sensor, light emitted from the light-emitting portion and transmitted by any one of the detection-object parts is received by the light-receiving portion, the rack has rack teeth formed on a side face of a rack body, the rack is provided with a plurality of opening portions that penetrate the rack body from an upper surface thereof in a thickness direction thereof and that are arranged at predetermined intervals on a straight line extending in the width direction, and the plurality of detection-object parts are arranged at the plurality of opening portions, respectively.

2. The sheet stacking unit according to claim 1 wherein the plurality of detection-object parts have different light transmissivities from one another due to their thickness differences.

3. The sheet stacking unit according to claim 1, wherein the plurality of detection-object parts have surfaces subjected to emboss processing of different sizes of pits and bumps, thereby differentiated in transmissivity from one another.

4. The sheet stacking unit according to claim 1, wherein the plurality of detection-object parts are provided with sheet members of different light transmissivities, respectively.

5. The sheet stacking unit according to claim 1, wherein the plurality of detection-object parts are provided at positions corresponding to sheet widthwise sizes, respectively, of plural kinds of regular-sized sheets.

6. A sheet conveying device comprising: the sheet stacking unit according to claim 1; and a sheet conveying part which conveys the sheets placed on the sheet stacking unit.

7. An image forming apparatus comprising: the sheet conveying device according to claim 6; and an image forming unit.

* * * * *